US005266254A

United States Patent [19]

Fischer et al.

[11] Patent Number: 5,266,254

[45] Date of Patent: Nov. 30, 1993

[54] PROCESS FOR THE HIGH-SPEED SPINNING OF MONOFILAMENTS

[75] Inventors: Klaus Fischer; Halim Baris, both of Luzern, Switzerland

[73] Assignee: Rhone-Poulenc Viscosuisse SA, Emmenbrücke, Switzerland

[21] Appl. No.: 761,935

[22] PCT Filed: Feb. 5, 1991

[86] PCT No.: PCT/CH91/00027

§ 371 Date: Sep. 16, 1991

§ 102(e) Date: Sep. 16, 1991

[87] PCT Pub. No.: WO91/11547

PCT Pub. Date: Aug. 8, 1991

[30] Foreign Application Priority Data

Feb. 5, 1990 [CH] Switzerland ..... 354/90

[51] Int. Cl.[5] ..... D01D 5/16

[52] U.S. Cl. ..... 264/130; 264/176.1; 264/210.8; 264/211.15; 264/211.18; 264/290.7; 264/210.4

[58] Field of Search ..... 264/130, 210.8, 290.5, 264/290.7, 211.15, 210.3, 210.4, 176.1, 103, 211.18; 428/364

[56] References Cited

U.S. PATENT DOCUMENTS

| | | | |
|---|---|---|---|
| 3,511,905 | 5/1970 | Martin | 264/210.8 |
| 3,715,421 | 2/1973 | Martin et al. | 264/130 |
| 3,899,562 | 8/1975 | Seidl | 264/103 |
| 3,996,324 | 12/1976 | Landenberger et al. | 264/103 |
| 4,456,575 | 6/1984 | Smith et al. | 264/211.17 |
| 4,731,218 | 3/1988 | Damhorst et al. | 264/130 |
| 4,940,559 | 7/1990 | Kretschmann et al. | 264/130 |
| 5,087,401 | 2/1992 | Yokoyama et al. | 264/130 |
| 5,108,675 | 4/1992 | Matsuo et al. | 264/130 |

FOREIGN PATENT DOCUMENTS

| | | | |
|---|---|---|---|
| 3534079 | 4/1986 | Fed. Rep. of Germany | 264/210.3 |
| 273291A | 11/1989 | Fed. Rep. of Germany | 264/290.7 |
| 47-12886 | 4/1972 | Japan | 264/290.5 |
| 60-215811 | 10/1985 | Japan | 264/210.3 |
| 475375 | 8/1969 | Switzerland . | |
| 712779 | 7/1954 | United Kingdom . | |

*Primary Examiner*—Jeffery Thurlow
*Attorney, Agent, or Firm*—Michael J. Striker

[57] ABSTRACT

A process of high-speed spinning of a set of thermoplastic monofilaments having a linear density from 1 to 30 dtex, includes spinning to obtain melt-spun thermoplastic monofilaments and airblast cooling of the melt-spun monofilaments. To produce a particularly fine monofilament at high winding speeds, the process also includes guiding the thermoplastic monofilaments directly over a fork-like friction element having axially parallel, spaced apart upper and lower contacting friction surfaces during the airblast cooling, and then spin finishing and winding up the thermoplastic monofilaments. An apparatus for melt-spinning including the friction element is described. The product monofilament produced by the process can have an elongation of 20 to 45%, a strength of 36 to 60 cN/tex; a boil shrinkage of 2 to 15%; an Uster % less than 1 and a uniformly round cross section.

4 Claims, 2 Drawing Sheets

PROCESS FOR THE HIGH-SPEED SPINNING OF MONOFILAMENTS

BACKGROUND OF THE INVENTION

The present invention relates to a process for high-speed spinning of a plurality of thermoplastic monofilaments each of from 1 to 30 dtex and a device for carrying out the process and also the monofilaments produced thereby.

The take-off of melt-spun multifilament yarns over brake pins for the purpose of influencing orientation and crystallization by friction is known (CH-A-475 375). In the known device, an undriven pair of rollers for stabilizing the converged multifilament yarns is provided between nonadjustable, fixed brake pins. However, such a device is not suitable for producing monofils.

Fine monofilaments of up to about 33 dtex are spun at speeds of less than 1000 m/min, cooled with an airblast, wound up and separately drawn in a second operation at about 750 m/min.

Although the properties of the monofils produced in a known manner, in particular their strength, are satisfactory, the slow spinning and separate/drawing is very uneconomical. There has long been a need to simplify and rationalize the production of monofils.

SUMMARY OF THE INVENTION

It is an object of the present invention to provide a process for producing fine monofilaments which without a separate drawing process but with high winding speeds achieves and/or exceeds the properties of known monofilaments.

It is a further object to vary the process in such a way that desired properties can be conferred on the monofilaments in a specific manner via the setting parameters of the device.

The aforementioned object is achieved according to the invention when, during airblast cooling, the melt-spun monofilaments are guided directly over a friction element, then spin finished and wound up.

Directly means that between a spinning jet and a friction element there is no contact with the running filament. This surprisingly is the first time that it has been possible to produce a monofilament at very high speed in a single stage.

The take-up speed lies within the range from 3000 to 6000 m/min, preferably from 4000 to 5000 m/min.

The process can be used for thermoplastics such as polyesters of any kind, polyamides, in particular those which are known as nylon 66 or nylon 6, and also polyacrylic, polyvinylidene fluoride, polyethylene or polypropylene.

The device for carrying out the process consists essentially of a friction element situated between the spinning jet and the spin finish application means. The friction element is preferably fork-like, rotatable and movable relative to the spinning jet.

In a fork-like construction of the friction element, the two opposite friction surfaces, an upper friction surface and a lower friction surface, are arranged parallel. These parallel surfaces can be provided on circular cylindrical rods or pins whose axes are parallel.

A friction element, once it has been set at a certain distance from the spinning jet and fixed in place, can be rotated about its axis continuously or in fixed stages in such a way that a filament extending between the friction surfaces can be provided with a desired tension.

The stepwise adjustment has the advantage that the desired positions are always exactly relocatable, ensuring a constant, reproducible filament tension.

The friction element can consist of a plurality of pins which have a cylindrical or else oval surfaces. However, it is also possible to use other bodies having curved surfaces.

It is advantageous, to achieve the desired filament properties, to select a distance of the friction elements from the spinning jet within the range from 20 to 280 cm, depending on the desired monofilament linear density.

The twist angle $\alpha$ between the filament transport direction and the common axis of the friction element surfaces should be within the range from 0 to 40 degrees, and the wrap angle between friction element and monofil should be within the range from 50° to 150°. When the friction surfaces are provided on two spaced apart parallel pins the "common axis of the friction element surfaces" is a straight line drawn through the axes of the pins in the same plane as the filament.

The monofilament produced by the process should meet the following conditions at one and the same time:

a) an elongation of 20–45%
b) a strength of 36–60 cN/tex
c) a boil shrinkage of 2–15%
d) an Uster irregularity of $<1\%$ and
e) a uniform round cross-section.

BRIEF DESCRIPTION OF THE DRAWING

The objects, features and advantages of the present invention will now be illustrated in more detail by the following detailed description, reference being made to the accompanying drawing in which.

A DETAILED DESCRIPTION OF THE PREFERRED EMBODIMENTS

Figure 1:
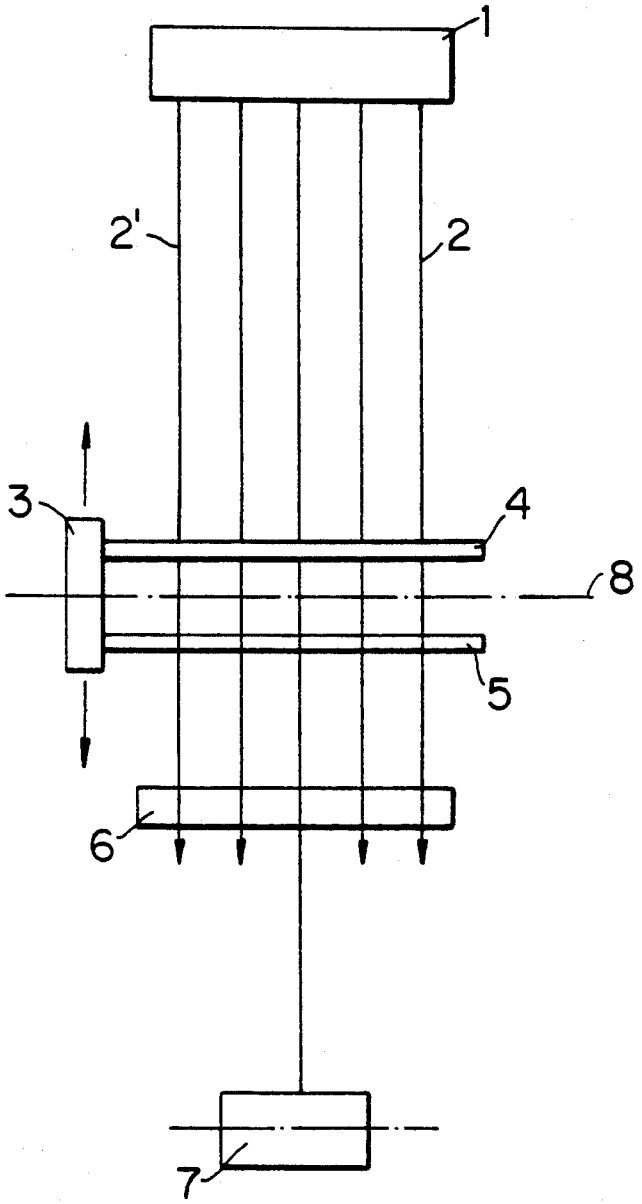
FIG. 1 is a plan view of novel arrangement of the friction elements within a blasting cell containing a plurality of monofilaments.

In FIG. 1, reference numeral 1 refers schematically to a spinning jet. Between the spinning jet 1 and a winder 7 there is disposed a friction element 3. The friction element 3 is adjustable in height, as indicated by arrows. The friction element 3 consists of a friction surface 4 and a friction surface 5, which are arranged rotatable about an axis 8. The friction element 3 is rotatable, so that a monofilament 2, or a set of monofilaments, represented by the two outside monofilaments 2 and 2', passing between the friction surface 4 and the friction surface 5 can be subjected to a friction force. Between the friction element 3 and the winder 7 there is provided a device 6 for applying a spin finish.

Figure 2A:
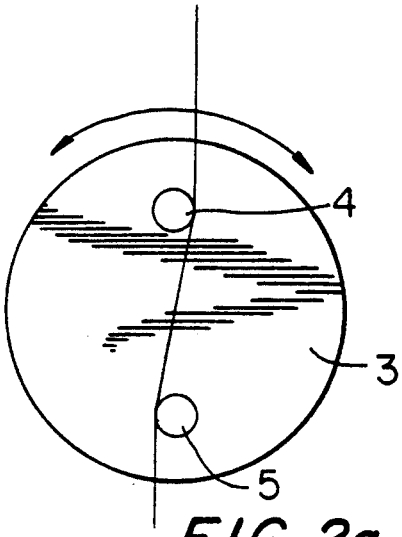
FIG. 2 shows the friction element in a rotatable arrangement.

In FIG. 2 the rotatability of the friction element is indicated by arrows. In FIG. 2*a* the monofilament 2 passes between the friction surface 4 and the friction surface 5.

Figure 2B:
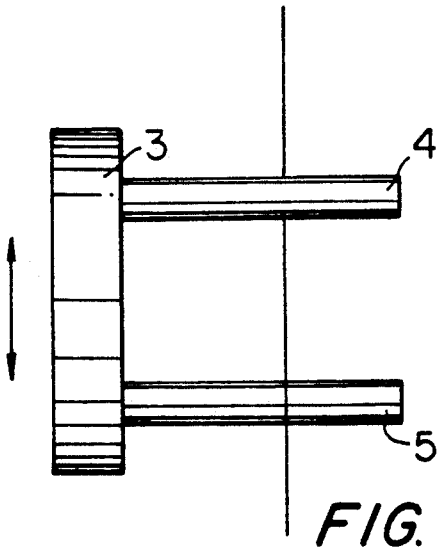

In FIG. 2*b*, the friction element 3 and the friction surfaces 4 and 5 are shown in side view.

Figure 3A:
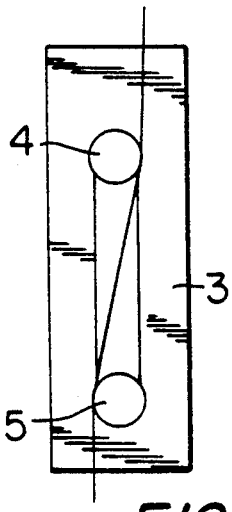
FIG. 3 shows the friction element with variable spacing of the friction surfaces.
Figure 3B:
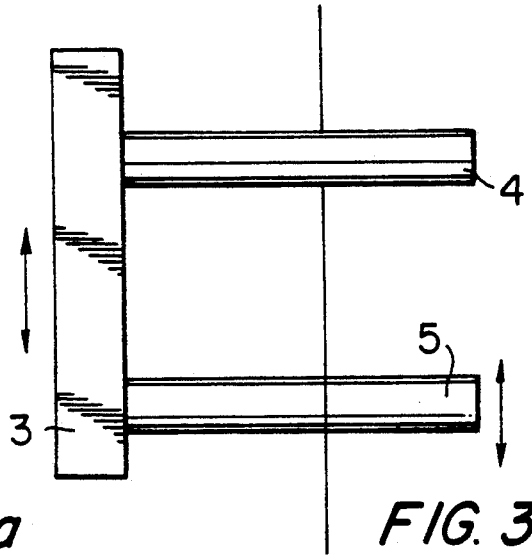

In FIG. 3, the height adjustability of the friction element 3 as a whole and that of the friction surface 5 relative to 4 are indicated by double arrows. In FIG. 3*a* the filament passes between the friction surface 4 and the friction surface 5. FIG. 3*b* is a side view of FIG. 3*a*.

Figure 4A:
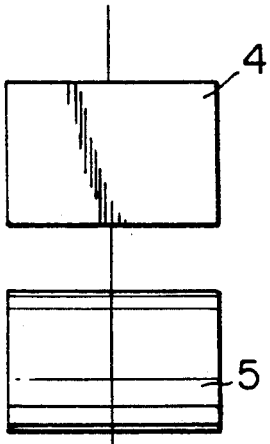
FIG. 4 shows a variant of the friction element with a laterally adjustable arrangement of the friction surfaces.
Figure 4B:
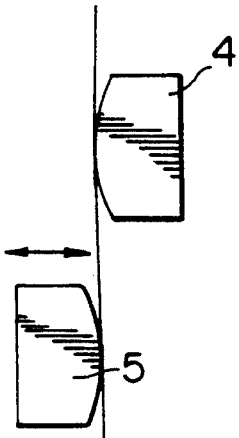

In FIG. 4*a*, the friction surfaces 4 and the friction surfaces 5 are mutually adjustable, it being advantageous for one friction surface to be fixed in place and for the other to be slidable. The filament 2 passes between friction surfaces 4 and 5. FIG. 4*b* is a side view of FIG. 4*a*.

In operation, a set of monofilaments consisting of the monofilaments 2, 2' bounding the set emerge from the spinning jet 1, pass at high speed in parallel formation through the friction element and are drawn over the friction surface 4 and the friction surface 5 by means of the winder 7. Between the friction element 3 and the winder 7 a suitable spin finish 6 is applied. If desired, it is also possible for a godet to be arranged between friction element and winder. The resulting monofilament is ready for further processing.

EMBODIMENT EXAMPLE 1

Polyester having a V.I. of 74 dl/g and a melt temperature of about 287° C. is extruded through a spinning jet 1×6/0.33/4D and taken off at a speed of 5000 m/min and cooled with an airblast at 0.25–0.4 m/s. The distance between the spinning jet and the friction element is 30–160 cm depending on the linear density. The filament is subjected to the application of a spin finish at a distance of h+40 cm. The friction elements (FIG. 2) are adjusted in three different stages, 0°, 20° and 40°, measured relative to the filament transport direction, the twist angle in the case of the friction element of FIG. 2 being the angle between the filament transport direction and a line passing through the axes of the friction surfaces 4 and 5 or the axes of the pins on which they are provided. The measured results are depicted in Table 1. (Winding speed 5000 m/min)

In the Table,

| | |
|---|---|
| setting 2 means 0°, setting 3 means 20° | and twist angle friction element/filament |
| setting 4 means 40° | |

The wrap angles (friction element according to FIG. 2) are in setting

2: 70°

3: 100°

4: 130°

Wrap angle in friction element of FIG. 3 50°–100°.

EMBODIMENT EXAMPLE 2

Tab. 2 summarizes the yarn properties of a run at a winding speed of 4000 m/min. Other spinning conditions as in Example 1.

Dt=elongation at break

Ft=tensile strength

KS=boiling water shrinkage

TABLE 1

| Linear density [dtex] | h [cm] | Setting | Dt [%] | Ft [cN/tex] | KS [%] |
|---|---|---|---|---|---|
| 2.8 | 30 | 2 | 41.0 | 38.0 | 3.5 |
| | 40 | 2 | 42.7 | 35.0 | 5.0 |
| | 40 | 3 | 33.0 | 41.0 | 5.0 |
| 4.3 | 40 | 2 | 42.0 | 37.2 | 3.5 |
| | 60 | 2 | 39.0 | 39.5 | 4.5 |
| | 80 | 2 | 43.0 | 37.2 | 5.0 |

TABLE 1-continued

| Linear density [dtex] | h [cm] | Setting | Dt [%] | Ft [cN/tex] | KS [%] |
|---|---|---|---|---|---|
| | 60 | 3 | 25.0 | 36.5 | 4.0 |
| | 80 | 3 | 40.0 | 36.0 | 15.0 |
| 6.1 | 40 | 2 | 24.0 | 37.7 | 2.0 |
| | 60 | 2 | 29.0 | 37.0 | 2.5 |
| | 80 | 2 | 33.0 | 41.8 | 3.0 |
| | 100 | 2 | 48.0 | 38.5 | 7.0 |
| | 80 | 3 | 25.0 | 46.0 | 3.5 |
| | 100 | 3 | 30.0 | 41.8 | 6.0 |
| | 100 | 4 | 21.0 | 47.5 | 5.5 |
| | 120 | 4 | 36.0 | 37.1 | 15 |
| 8 | 60 | 2 | 30.0 | 41.3 | 2.0 |
| | 80 | 2 | 28.0 | 46.3 | 2.5 |
| | 100 | 2 | 35.0 | 40.7 | 3.5 |
| | 120 | 2 | 41.0 | 39.0 | 4.5 |
| | 80 | 3 | 35.0 | 41.3 | 4.0 |
| | 100 | 3 | 35.0 | 42.7 | 4.5 |
| | 120 | 3 | 42.0 | 42.7 | 4.5 |
| 10 | 80 | 2 | 30.0 | 43.0 | 2.0 |
| | 90 | 2 | 31.0 | 46.0 | 2.0 |
| | 100 | 2 | 41.0 | 42.0 | 2.5 |
| | 120 | 2 | 45.0 | 40.0 | 3.0 |
| | 80 | 3 | 33.0 | 42.0 | 3.0 |
| | 90 | 3 | 36.0 | 43.0 | 3.0 |
| | 100 | 3 | 25.0 | 50.0 | 3.0 |
| | 120 | 3 | 26.0 | 46.0 | 5.0 |
| | 140 | 3 | 32.0 | 42.6 | 4.0 |
| | 160 | 3 | 45.0 | 39.0 | 8.0 |
| | 140 | 4 | 22.0 | 51.0 | 4.5 |
| | 160 | 4 | 32.0 | 40.0 | 7.0 |
| 12.8 | 100 | 2 | 29.0 | 41.7 | 2.0 |
| | 100 | 3 | 25.0 | 50.0 | 2.5 |
| 13.2 | 130 | 2 | 33.0 | 47.0 | 2.5 |
| | 140 | 2 | 30.0 | 47.0 | 2.5 |
| | 150 | 2 | 34.0 | 44.7 | 3.0 |
| | 130 | 3 | 30.0 | 45.0 | 3.5 |
| | 150 | 3 | 25.0 | 48.0 | 3.0 |

TABLE 2

| Linear density [dtex] | h [cm] | Setting | Dt [%] | Ft [cN/tex] | KS [%] |
|---|---|---|---|---|---|
| 2 | 35 | 2 | 40.0 | 40.0 | 3.0 |
| 4 | 50 | 2 | 38.0 | 42.0 | 3.0 |
| 6 | 70 | 2 | 37.0 | 43.0 | 2.5 |
| 10 | 90 | 2 | 40.0 | 40.0 | 3.0 |
| | 90 | 3 | 32.0 | 47.0 | 3.5 |
| 15 | 130 | 3 | 24.0 | 55.0 | 2.5 |
| | 140 | 3 | 33.0 | 45.0 | 2.5 |
| | 140 | 2 | 38.0 | 41.5 | 3.0 |
| 17 | 150 | 3 | 33.0 | 46.5 | 3.0 |
| 20 | 150 | 2 | 34.0 | 43.0 | 2.5 |
| | 165 | 3 | 30.0 | 47.0 | 4.0 |
| 25 | 185 | 2 | 37.0 | 45.0 | 2.5 |
| | 210 | 3 | 34.0 | 50.5 | 3.5 |
| 28 | 230 | 2 | 33.0 | 48.0 | 3.0 |

Winding Speed 4000 m/min.

By applying friction in a specific manner to a monofilament during the cooling phase it has been possible to vary elongation and strength within the claimed range in a simple manner without any other apparatus. The arrangement of the present invention makes it possible for the first time to produce a multiplicity of identical monofilaments within the linear density range of from 1 to 30 dtex at speeds above 3500 m/min in a simple manner using friction elements and in a single stage, i.e. without additional drawing process. The monofilaments obtained are superior to existing grades in respect of % Uster, roundness and dynamometric properties.

While the invention has been illustrated and described as embodied in a process and device for high-speed spinning of monofilaments, and monofilaments produced therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In a process of high-speed spinning of a thermoplastic monofilament at a take-up speed of 4000 to 6000 m/min, said thermoplastic monofilament having a linear density from 2.8 to 30 dtex, said process comprising the step of airblast cooling of the thermoplastic monofilament, the improvement comprising guiding the thermoplastic monofilament directly over a friction element (3) during the airblast cooling, and then spin finishing and winding up the thermoplastic monofilament.

2. The improvement as defined in claim 1, wherein the thermoplastic monofilament is made from a material selected from the group consisting of polyesters, polyamides, polyacrylics, polyvinylidene fluorides, polyethylene and polypropylene.

3. In a process of high-speed spinning of a thermoplastic monofilament at a take-up speed of 4000 to 5000 m/min, said thermoplastic monofilament having a linear density from 2.8 to 30 dtex, said process comprising the step of airblast cooling of the thermoplastic monofilament, the improvement comprising the steps of adjustably tensioning the thermoplastic monofilament by passing the thermoplastic monofilament directly over a fork-like rotatable friction element (3) having axially parallel spaced-apart upper and lower friction surfaces during airblast cooling, said thermoplastic monofilament passing between and contacting the upper and lower friction surfaces; then spin finishing and winding up the thermoplastic monofilament.

4. The improvement as defined in claim 3, wherein the thermoplastic monofilament is made from a material selected from the group consisting of polyesters, polyamides, polyacrylics, polyvinylidene fluorides, polyethylene and polypropylene.

* * * * *